United States Patent [19]

Uchida

[11] 4,323,768

[45] Apr. 6, 1982

[54] APPARATUS FOR COUNTING SHEETS AND DISCRIMINATING DIFFERENT KINDS THEREOF

[75] Inventor: Shinya Uchida, Tokyo, Japan

[73] Assignee: Laurel Bank Machine Co., Ltd., Tokyo, Japan

[21] Appl. No.: 91,886

[22] Filed: Nov. 7, 1979

[30] Foreign Application Priority Data

Dec. 22, 1978 [JP] Japan ..... 53-159637

[51] Int. Cl.[3] ..... B65H 3/12

[52] U.S. Cl. ..... 235/92 SB; 271/95

[58] Field of Search ..... 271/95, 96, 106, 30 A, 271/91, 112; 235/92 SB

[56] References Cited

U.S. PATENT DOCUMENTS 3,904,189 9/1975 Murakami ..... 271/95

3,976,292 8/1976 Yoshida ..... 271/95

4,021,293 5/1977 Total ..... 271/95 X

*Primary Examiner*—Richard A. Schacher

*Attorney, Agent, or Firm*—Fleit & Jacobson

[57] ABSTRACT

An apparatus for counting bendable sheets and discriminating different kinds thereof has a plurality of rotary suction heads for deflecting the sheets one at a time away from a stack of sheets held in a vertical direction on a holder and has a system for optically detecting the height of a sheet deflected away from the stack. Each of the suction heads has at its top a supporting member for engaging with the surface of a sheet which has been deflected away from the stack. The deflected sheet is engaged at its opposite surfaces with the supporting members of two adjacent suction heads, thus being supported in an upright state without bending downwardly.

6 Claims, 5 Drawing Figures

APPARATUS FOR COUNTING SHEETS AND DISCRIMINATING DIFFERENT KINDS THEREOF

BACKGROUND OF THE INVENTION

This invention relates to an apparatus for counting sheets such as bank notes and discriminating different kinds thereof.

In general, this type of apparatus is designed to count a number of bendable sheets, such as bank notes, of a particular kind while discriminating or detecting different kinds of bank notes intermingled among the particular kind of bank notes.

Conventionally, in this type of apparatus, as shown in FIG. 1, a stack of bendable sheets A, bank notes, for example, of a particular kind are placed on a holder 1 with their shorter edges in the vertical direction. The holder 1 is then rotated toward a rotary disk 2 disposed near the holder 1 so that the stack of bank notes A is held between the upright wall of the holder 1 and a support rod 3 disposed against the holder 1, and at the same time, one side surface of the stack of bank notes A comes into contact with one of a plurality of rotary suction heads 4 which are arranged in a circle on the disk 2. The suction head 4 suckingly attracts the outermost bank note A by means of a vacuum pump (not shown) while the suction heads 4 are rotated about their own axes and at the same time the disk is rotated about the axis thereof by means of a driving device (not shown). Thus, the bank notes A are attracted, one at a time, by the suction heads 4 and deflected away from the stack of bank notes A thereby making counts. At the same time, in order to discriminate different kinds of bank notes, which might be included among the stack of bank notes A placed on the holder 1, form the particular kind of bank notes, the upper corner portion (the shadowed portion in the Figure) of each bank note, at the time it is sucked onto the suction head 4 and deflected away from the stack of bank notes A, is subjected to optical detection by a discriminating system which comprises a light-projecting member 5 and a light-receiving member 6 thereby to optically detect or examine the height, i.e., the length of the shorter side, of the bank note.

In such prior art apparatus, however, there is a problem that, when a bank note is deflected away from the stack of bank notes A by the suction head 4, the deflected corner portion of this bank note, which is to be subjected to optical detection, often bends downward toward the stack of bank notes A on the holder 1. As a result, the bank note is detected to have less height, and accordingly this bank note is erroneously judged to be of a different sort.

SUMMARY OF THE INVENTION

It is, therefore, an object of the invention to provide an improved apparatus of the above-mentioned type for counting bendable sheets and discriminating different kinds thereof, wherein the corner portions of the bendable sheets, after they have been attracted by the suction head and deflected away from the stack of sheets, are prevented from bending downward, whereby correct discrimination and counting of sheets can be obtained.

In an apparatus of the above-mentioned type for counting bendable sheets and discriminating different kinds thereof according to the invention, each of the suction heads has on its top a supporting member extending upward therefrom for supporting the sheets, which have been deflected away from the stack of sheets, in an upright state without bending. Preferably, at least a portion of the periphery of the supporting member projects outward with respect to the periphery of the section head. When a sheet is deflected by a suction head away from the stack of sheets, the opposite surfaces of this deflected sheet come into engagement with the supporting members of two adjacent suction heads, and thus the sheet is prevented from bending downward thereby allowing correct optical detection regarding the height thereof.

DESCRIPTION OF THE DRAWINGS

Other objects and advantages of the present invention will become apparent from the following description made with reference to the accompanying drawings, in which.

DESCRIPTION OF THE PREFERRED EMBODIMENTS

Embodiments of the present invention will now be described in detail with the reference to the accompanying drawings.

Figure 1:
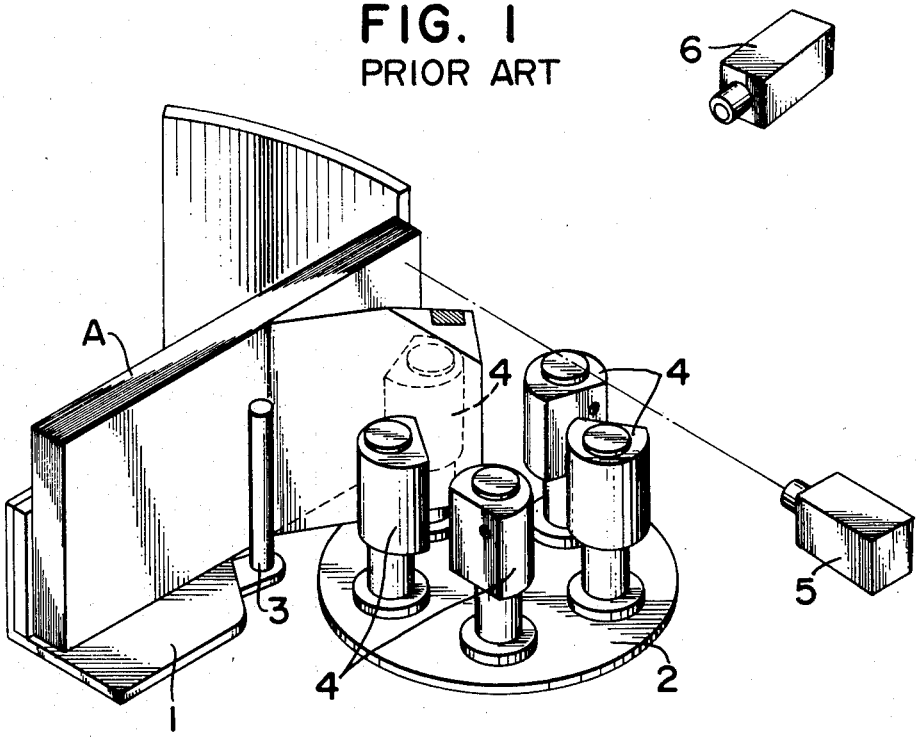
FIG. 1 PRIOR ART
FIG. 1 is a perspective view showing a conventional apparatus for counting bendable sheets and discriminating different kinds thereof.
Figure 2:
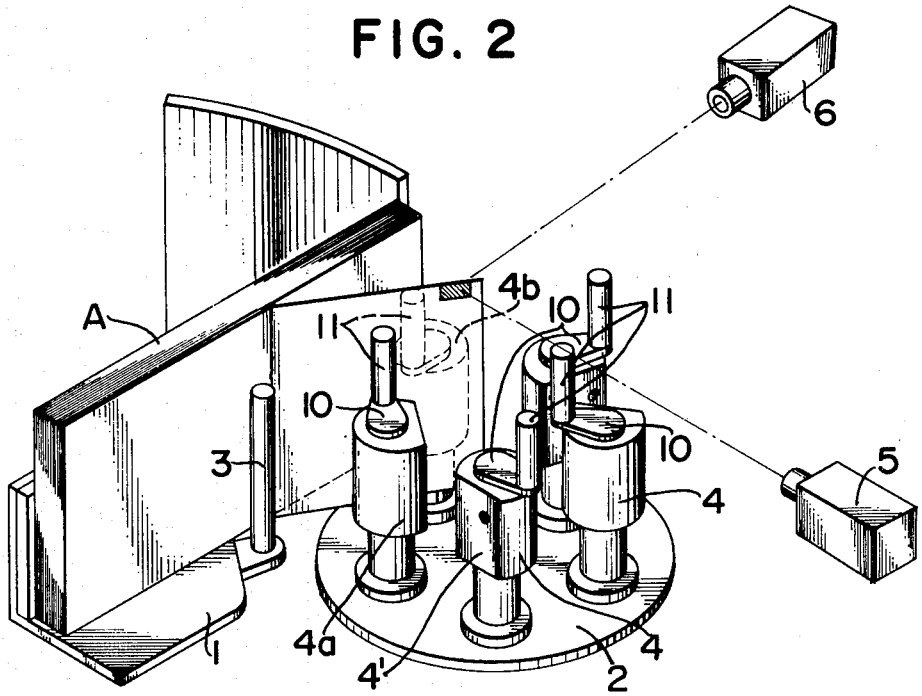
FIG. 2 is a perspective view showing an embodiment of the apparatus according to the invention.
Figure 3:
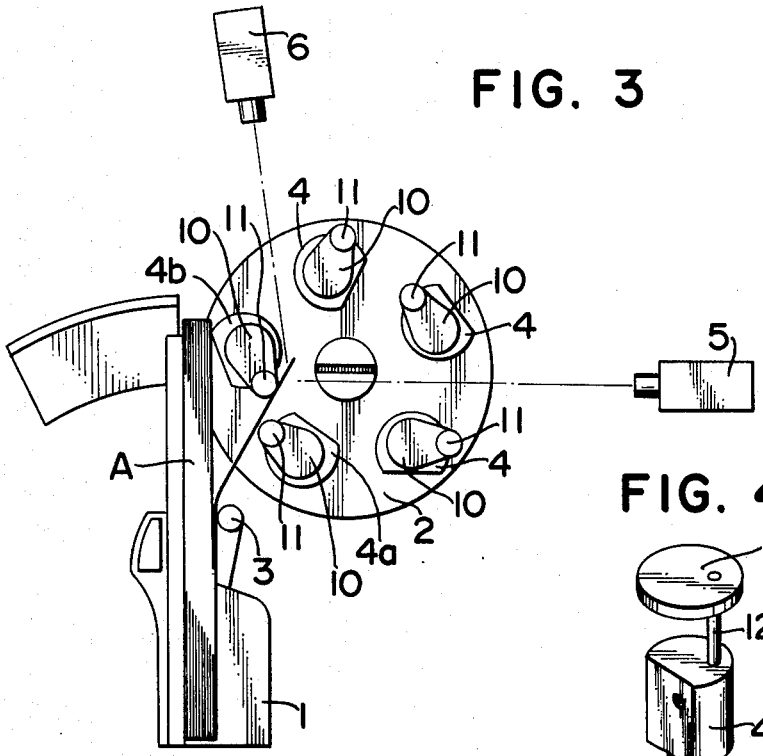
FIG. 3 is a plan view of the embodiment of FIG. 2.

An embodiment of the invention will now be described in connection with FIGS. 2 and 3, wherein similar parts as those in FIG. 1 are indicated by like numerals, and accordingly detailed description thereof will be omitted. In the following description, bank notes will be used as an example of bendable sheets.

Secured on the top of each of suction heads 4 carried on a rotary disk 2 disposed near a holder 1 is a mounting plate 10. The end portion of the mounting plate 10 projects outwardly of the periphery of the head 4 in a horizontal direction and righwardly of the attracting face 4' of head 4 as viewed from the front. Mounted on this projecting end portion of the mounting plate 10 is a vertical rod-like support member 11 which is eccentrically apart from the center axis of the suction head 4 so as to contact with a bank note in a manner described below. As best seen in FIG. 3, after one surface of an end portion of a bank note has been attracted by a first suction head **4*a* and this end portion has been deflected, by rotation and revolution of the suction head, away from the stack of bank notes A, the other surface of this deflected end portion of the bank note comes, due to its resiliency, into contact with the support member 11 mounted on the next or second suction head 4*b*, which will attract the next bank note, while said one surface of the deflected end portion of bank note is still in contact with the support member 11 of the first suction head 4*a***.

Operation of the apparatus having the above-described construction according to the invention will now be described. A stack of bank notes A is placed on the holder 1, and the holder 1 is driven toward the rotary disk 2 to bring the outer surface of the stack of bank notes A into contact with the suction head 4 for counting the bank notes one after another, in the same manner as in the conventional apparatus. That is, one surface of the outermost bank note A is attracted by the first suction head 4*a* and is deflected, by rotation and revolution of the head 4, away from the stack of bank notes A. The other surface of this deflected bank note A comes, due to its resiliency, into contact with the support member 11 of the second suction head 4*b*, while said one surface of this deflected bank note is still in contact with the support member 11 of the first suction head 4*a*. Thus, this deflected bank note A is held between the support members 11, 11 of the adjacent suction heads 4*a*, 4*b* in the vertical direction. The bank note A held by the adjacent two support members 11, 11, is prevented from swinging or bending due to air resistance thereagainst, vibration of the apparatus during operation, or the like. Thus, the corner portion of bank note will not bend downwardly, and will be correctly subjected to the optical detection made by a discriminating system comprising a light-projecting member 5 and a light-receiving member 6. Accordingly, bank notes of large width, such as 10,000-yen notes which are at present the largest-sized bank notes in Japan, can be prevented from bending downward and be subjected to correct detection. It is needless to say that bending of corner portions causes no trouble in the mere counting of bank notes.

Figure 4:
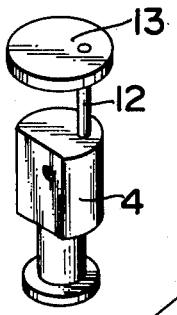
FIG. 4 is a perspective view showing the essential portion of another embodiment of the invention.

While, in the above embodiment, the suction heads 4 are provided at their tops with the mounting plates 10 which carry thereon the rod-like supporting members 11 which are positioned outwardly of the peripheries of the heads 4, the invention is not limited to this structure and can have another construction such as shown in FIG. 4. Referring to FIG. 4, each of the suction heads 4 is provided at its top with a vertical support pin 12 which carries on its top a disk 13 of larger diameter than that of the above-described supporting member 11. With the construction shown in FIG. 4, a bank note, which has been deflected by a first suction head 4 away from the stack of bank notes, can be held between the periphery of the disk 13 of this first suction head 4 and the pheriphery of the disk 13 of the next suction head 4 for a longer period of time than that which can be obtained by the above-described support members 11, 11.

Figure 5:
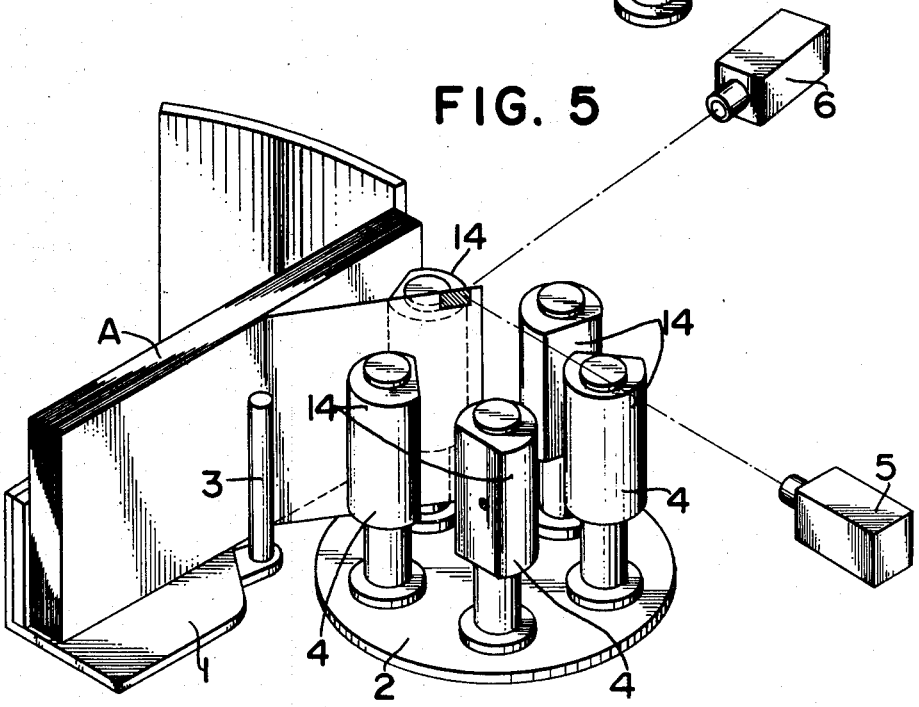
FIG. 5 is a perspective view showing a further embodiment of the invention.

FIG. 5 shows a further embodiment of the invention, wherein each of the suction heads 4 has at its top an integral vertical extension 14 which has the same peripheral configuration as that of the head 4. This construction of FIG. 5 is a little inferior to the above-described two embodiments in effectiveness of preventing the corner portion of bank notes from bending downward but is simpler in fabrication as it requires no special parts.

While the description has been made by taking bank notes as an example, the invention can be applied to various kinds of bendable sheets.

As will be apparent from the above, according to the invention, bendable sheets of any size can be prevented from bending downwardly at the time of counting, and accordingly correct discrimination and counting can be attained.

While, in the above, description has been made in connection with the preferred embodiments of the invention, the invention is not limited to these, and it should be understood that various changes and modifications can be made without departing from the spirit and the scope of the invention.

What is claimed is:

1. In an apparatus for counting bendable sheets and discriminating different kinds thereof including a holder for holding a stack of bendable sheets in a vertical direction, a plurality of rotary suction heads for suckingly attracting the sheets to deflect them one at a time away from the stack thereby to count the number of the sheets, and means for discriminating different kinds of sheets by optically detecting the height of the sheet deflected away from the sack, the improvement comprising: supporting members mounted at the tops of said plurality of suction heads for supporting the sheet, which has been deflected away from said stack of sheets, in an upright state by making engagement with the opposite surfaces of the sheet, each of said supporting members being a vertical rod extending upwardly from a position which is outward of the periphery of said suction head.

2. An apparatus according to claim 1 wherein a mounting plate is secured on top of each of said suction heads with a portion of the mounting plate projecting outwardly of the periphery of the suction head, said vertical rod extending upwardly from said projecting portion.

3. An apparatus for counting bendable sheets and for discriminating between different kinds of sheets being counted comprising:

holding means for holding a stack of bendable sheets in a vertical orientation;

a plurality of rotary suction heads having first surfaces receiving suction for suckingly attracting sheets to deflect them one at a time away from the stack so that the sheets are individually counted; and means for discriminating different kinds of sheets by optically detecting the height of the sheet deflected away from the stack, each of said suction heads having a supporting member vertically spaced above said first surface for supporting the sheet deflected away from said stack of sheets, the supporting members of two adjacent suction heads engaging opposite surfaces of the sheet to hold the sheet upright while its height is optically detected, each of said supporting members being a vertical rod extending upwardly from a position which is outward of the periphery of said suction head.

4. In an apparatus for counting bendable sheets and discriminating different kinds thereof including a holder for holding a stack of bendable sheets in a vertical direction, a plurality of rotary suction heads for suckingly attracting the sheets to deflect them one at a time away from the stack thereby to count the number of the sheets, and means for discriminating different kinds of sheets by optically detecting the height of the sheet deflected away from the stack, the improvement comprising: supporting members mounted at the tops of said plurality of suction heads for supporting the sheet, which has been deflected away from said stack of sheets, in an upright state by making engagement with the opposite surfaces of the sheet, each of said supporting members being a disk of a larger diameter secured on the top of said suction head through a support pin.

5. An apparatus according to claim 4 wherein said support pin extends upwardly from the top surface of said suction head.

6. An apparatus for counting bendable sheets and for discriminating between different kinds of sheets being counted comprising:

holding means for holding a stack of bendable sheets in a vertical orientation;

a plurality of rotary suction heads having first surfaces receiving suction for suckingly attracting sheets to deflect them one at a time away from the stack so that the sheets are individually counted; and means for discriminating different kinds of sheets by optically detecting the height of the sheet deflected away from the stack, each of said suction heads having a supporting member vertically spaced above said first surface for supporting the sheet deflected away from said stack of sheets, the supporting members of two adjacent suction heads engaging opposite surfaces of the sheet to hold the sheet upright while its height is optically detected, each of said supporting members being a disk of a larger diameter secured on the top of said suction head through a support pin.

* * * * *